US008496540B2

(12) United States Patent
Soracco et al.

(10) Patent No.: US 8,496,540 B2
(45) Date of Patent: Jul. 30, 2013

(54) INTERCHANGEABLE GOLF CLUB HOSEL

(75) Inventors: Peter L. Soracco, Carlsbad, CA (US); Scott A. Knutson, Escondido, CA (US)

(73) Assignee: Acushnet Company, Fairhaven, MA (US)

( * ) Notice: Subject to any disclaimer, the term of this patent is extended or adjusted under 35 U.S.C. 154(b) by 370 days.

(21) Appl. No.: 12/760,721

(22) Filed: Apr. 15, 2010

(65) Prior Publication Data

US 2011/0256951 A1 Oct. 20, 2011

(51) Int. Cl.
*A63B 53/02* (2006.01)

(52) U.S. Cl.
USPC ..... 473/307; 473/288

(58) Field of Classification Search
USPC ..... 473/288, 307, 244–248, 296, 298–299
See application file for complete search history.

(56) References Cited

U.S. PATENT DOCUMENTS

| | | | | |
|---|---|---|---|---|
| 1,540,559 | A | 6/1925 | Murphy | |
| 1,844,812 | A * | 2/1932 | Thorpe | 473/308 |
| 4,526,374 | A * | 7/1985 | Ban | 473/231 |
| 4,805,941 | A | 2/1989 | Downing et al. | |
| 5,133,553 | A | 7/1992 | Divnick | |
| 5,165,762 | A | 11/1992 | Phillips | |
| 5,238,259 | A | 8/1993 | Wilson et al. | |
| 5,275,409 | A | 1/1994 | Currie | |
| 5,433,442 | A | 7/1995 | Walker | |
| 5,513,844 | A | 5/1996 | Ashcraft et al. | |
| 5,597,362 | A | 1/1997 | Lee et al. | |
| 5,765,658 | A | 6/1998 | Mayer | |
| 6,547,673 | B2 | 4/2003 | Roark | |
| 6,652,388 | B1 * | 11/2003 | Lenhof et al. | 473/306 |
| 6,767,422 | B1 | 7/2004 | Atsumi et al. | |
| 6,890,269 | B2 * | 5/2005 | Burrows | 473/307 |
| 7,074,135 | B2 * | 7/2006 | Moore | 473/296 |
| 7,115,046 | B1 * | 10/2006 | Evans | 473/307 |
| 7,226,364 | B2 * | 6/2007 | Helmstetter | 473/307 |
| 7,553,240 | B2 | 6/2009 | Burnett et al. | |
| 8,205,308 | B2 * | 6/2012 | Moore | 24/456 |
| 2004/0116197 | A1 * | 6/2004 | Benson | 473/239 |
| 2005/0049072 | A1 | 3/2005 | Burrows | |
| 2007/0197311 | A1 * | 8/2007 | Brady | 473/305 |

* cited by examiner

*Primary Examiner* — Stephen L. Blau
(74) *Attorney, Agent, or Firm* — Randy K. Chang

(57) ABSTRACT

A golf club with an improved interchangeable hosel is disclosed herein. More specifically, the improved interchangeable hosel is independent of the golf club head as well as the shaft; and has a non-threaded connection mechanism that releasably connects the shaft to the golf club head quickly and easily. The non-threaded connection mechanism disclosed in accordance with the present invention may generally utilize a circumferentially constricting clamping force to secure the shaft of the golf club to the head of the golf club.

14 Claims, 13 Drawing Sheets

INTERCHANGEABLE GOLF CLUB HOSEL

FIELD OF THE INVENTION

The present invention relates generally to a golf club with an improved interchangeable hosel having a non-threaded connection mechanism that releasably connects the shaft to the golf club head. More specifically, the present inventions relates to an interchangeable hosel having a non-threaded connection mechanism that allows the shaft to be removed from the golf club head quickly and easily. The non-threaded connection mechanism disclosed by the present invention may circumferentially contract to secure the shaft of the golf club to the head of the golf club.

BACKGROUND OF THE INVENTION

Simply put, the objective of the game of golf is to get the golf ball into the cup in the least amount of strokes possible. Despite the simplicity of the objective of the game of golf, the development of the equipment used by the golfer to achieve this simple goal has been extremely complex and technical. The golf ball, for example, began its technological journey as a featherie ball in the early stages of the game of golf, but transitioned into a gutta-percha golf ball that eventually developed into a wound golf ball. Although the wound golf ball was thought of as the most preferred method of golf ball construction during its days, recent technological advancements have further improved upon the wound golf ball by creating a urethane type golf ball that improves the distance and feel of the golf ball beyond what is achievable by any of the golf balls in the past.

Golf clubs, on the other hand, has also made significant technological advancements to help the golfer achieve this simple goal of getting a golf ball into the cup. One of the major advancements in golf club technology is the ability to use advanced materials such as titanium and carbon fiber to create a hollow golf club head to replace the original persimmon wood. Utilizing advanced materials such as titanium and carbon fiber allows the overall weight of the golf club to be reduced, creating discretionary weight that can be placed at more desirous location within the golf club head to increase the moment of inertia; which in turn makes the golf club more forgiving and easier to use for the average golfer.

Another example of advancements in golf club technology is the creating of a cavity in the rear back portion of an iron type golf club head. Although iron type golf club heads were initially designed as solid pieces of forged irons, the ability to shift the weight toward the perimeter of the iron type golf club head gives them a hollowed from the rear of the golf club head, creating what is commonly known as a cavity back. These cavity back iron type golf club heads improve the size of the sweet spot of the iron type golf club as well as the moment of inertia of the golf club head, making them more forgiving and easier to use for the average golfer.

To further complicate things, golf club shafts have also advanced significantly technologically to be able to severely affect the performance of a golf club. U.S. Pat. No. 6,767,422 shows one example of technological advancements in a golf club shaft technology that is 35-50 percent lighter than a conventional shaft while maintaining the outer diameter and structural characteristics of a conventional golf club shaft.

Despite all of the technological advancements in golf club technology to make the game of golf easier, the severe variations in an individual golfer's skill level and technique has prohibited the golf club designers from designing one golf club that maximizes the performance potentials of every single golfer. The different variation in an individual golfer's swing often requires the perfect club head and shaft for that individual golfer. Even if the golfer finds his perfect golf club, different weather and course conditions will often requiring adjustments to the various components of a golfer's golf club. Hence, it can be seen that although there is no perfect golf club suitable for every golfer, the correct combination of a technologically advanced golf club with a golf club head will allow the golfer to maximize his performance.

In order to strive to create a perfect golf club for each and every single golfer, golf club designers need to explore opportunities to customize the golf club and shaft combination in a way that allows different individual golfers to adjust a golf club to determine the ideal set up for his own individual needs. U.S. Pat. No. 1,540,559 to Murphy provides an early example of this attempt to allow customization and adjustability of a golf club by providing a golf club wherein the handle or shaft will be easily attachable and detachable via a threaded mechanism, but when attached will be held firmly in position. Although crude, this early attempt to allow the golfer to detach the shaft from the golf club head allows a golfer to experiment with different golf club shafts without the need to change the performance characteristics of the golf club head.

U.S. patent application No. 2005/0049072 to Burrows shows a further example of a customizable golf club while maintaining the same general concept of utilizing a threaded connection mechanism. U.S. patent application No. 2005/0049072 to Burrows discloses a temporary shaft-component connection that is designed with a metal adapter inserted onto a lower end of the club shaft, and includes one or more flat surfaces for reception into a matingly shaped socket in the hosel of a selected golf club head to prevent relative rotation between the club shaft and head.

Although threaded connection mechanisms are adequate to securely connect the golf club head to the shaft of the golf club, they are burdensome to install and uninstall due to the repetitive turning motion required by a threaded mechanism. In addition to being burdensome, installing and uninstalling threaded connection mechanisms often require an additional tool, making the golfer carry additional equipment that he may not even need or utilize very often.

U.S. Pat. No. 5,433,442 to Walker makes an attempt to address the cumbersome nature of the connectivity between a shaft and a golf club head by disclosing a golf club with a quick release head. Although U.S. Pat. No. 5,433,442 discloses a quick release pin positioned through the apertures of the hosel and rod to secure the pre-selected head to the rod and shaft, it still utilized screw threads formed within the bore that extends form the hosel end of the shaft as the main connection mechanism.

U.S. Pat. No. 5,513,844 to Ashcraft et al. makes another attempt to address the cumbersome nature of a threaded connection mechanism by disclosing a golf club head having a transverse slit that extends from the heel end transversely through the flat face. This slit creates a bore that can be tightened utilizing a pair of clamping screws, extending through one of the bores across the slit for threaded engagement with respective aligned bore. U.S. Pat. No. 5,513,844, although discloses a pair of clamping screws to remove the screws in an axial direction, still uses threaded screw in a planer direction; preventing a golfer from freeing himself of cumbersome and burdensome assembly tools.

Hence, as it can be seen from above, despite all the advancement in golf club technology and customization technology, the current art has been unable to sufficiently develop an attachment mechanism that is quick and easy without a threaded connection mechanism that requires an external tool.

BRIEF SUMMARY OF THE INVENTION

One aspect of the present invention is a golf club head comprising a shaft, a club head, and a hosel that is independent of the shaft and the club head and juxtaposed between the shaft and the club head. The hosel further comprises a non-threaded connection mechanism to secure the shaft to the club head wherein the non-threaded connection mechanism contracts the internal circumference of the hosel to secure the shaft to the club head.

In another aspect of the present invention, a golf club head with provided comprising a striking face at a forward portion of the golf club head for striking a golf ball, a body portion connected to an aft portion of the striking face to provide structural support, and a hosel that is independent of the striking face and the body adapted for connecting to a heel portion of the body. The hosel further comprises a first connection end adapted to connect to the heel portion of the body, a second connection end adapted to connect to the shaft, and a non-threaded connection mechanism protruding externally from the hosel, wherein the non-threaded connection mechanism reduces the internal circumference of the hosel to secure the shaft to the hosel.

In a further aspect of the present invention, a golf club head is provided comprising a body and a hosel. The hosel is releasably connected to a heel portion of the body and further comprises of a non-threaded connection mechanism to secure the shaft to the hosel. The non-threaded connection mechanism further comprises a first flap, a second flap, and a rotating clamp. The first flap runs lengthwise along the hosel extending outward from the hosel, a second flap, substantially parallel to the first flat, is also running lengthwise along the hosel extending outward from the hosel, wherein the two flaps are positioned in a way that the first flap and the second flap creates a gap in the internal circumference of the hosel. The rotating clamp is adapted to rotationally compress the first flap with the second flap in a way such that the rotating clamp decreases the internal circumference of the hosel when it compresses the first flap with the second flap.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
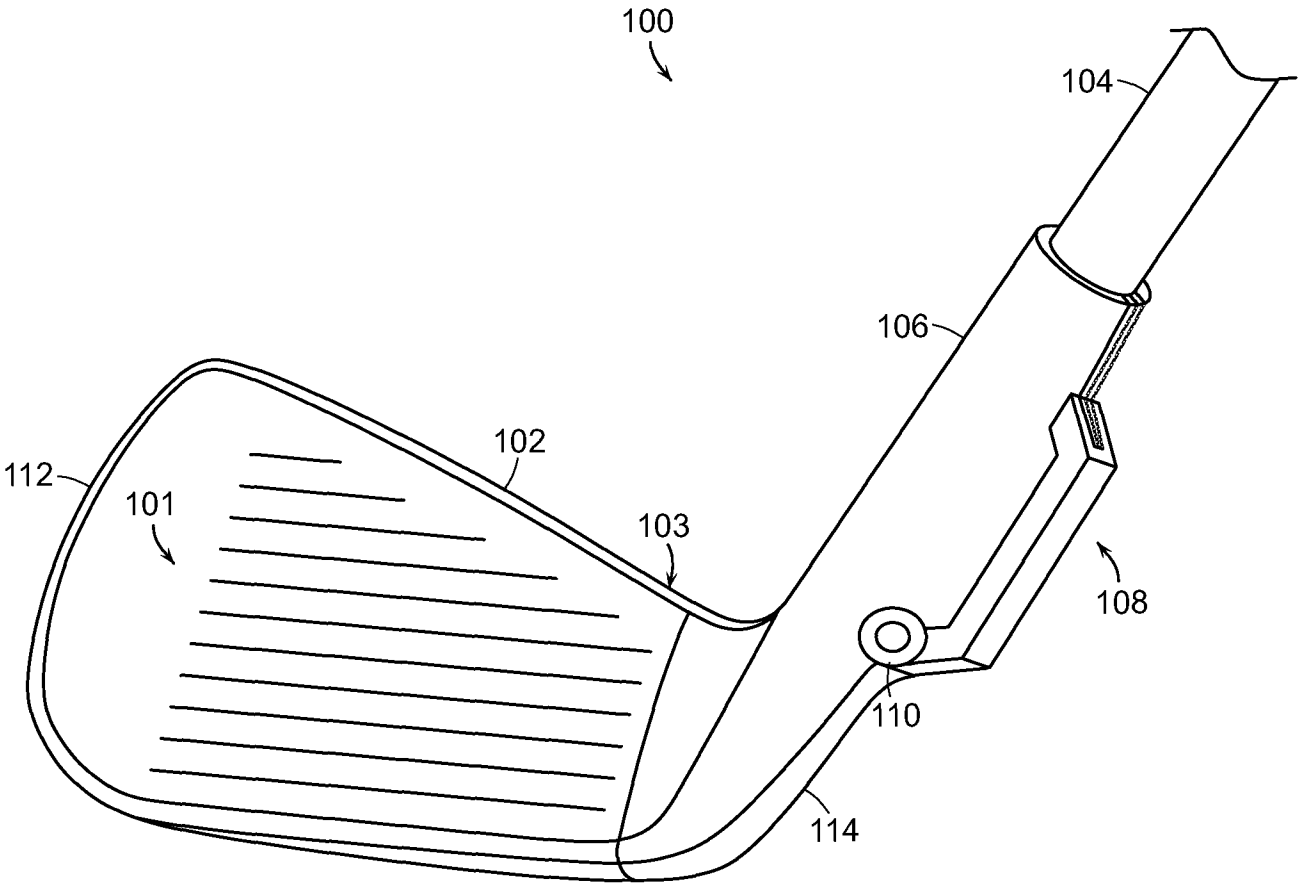
FIG. 1 shows a perspective view of a golf club in accordance with an exemplary embodiment of the present invention.

FIG. 1 of the accompanying drawings shows a perspective view of a golf club 100 in accordance with an exemplary embodiment of the present invention. Golf club 100 shown in FIG. 1 may generally have a club head 102 at a terminal end of the golf club 100 adapted for striking a golf ball (not shown). The club head 102 may generally have a striking face 101 near the forward portion of the club head 102 as well as a body 103 near the aft portion of the golf club head 102. The club head 102, as shown in the current exemplary embodiment, may generally be connected to a shaft 104 via a hosel 106. Unlike traditional golf club heads wherein the hosel has already been incorporated into the head of the golf club, hosel 106 in accordance with the current invention may generally be independent of the club head 102 as well as the shaft 104 and may be releasably juxtaposed between the club head 102 and the shaft 104. While traditional methods of assembly usually requires significant amount of epoxy within the hosel of the club head to securely connect the shaft to the hosel, the current invention utilizes a non-threaded connection mechanism 108 that has been incorporated into the hosel 106 to connect the shaft 104 with the club head 102 without the need of epoxy.

In order to secure the shaft 104 to the club head 102 without the need of epoxy, the non-threaded connection mechanism 108, as shown in the current exemplary embodiment in FIG. 1, may generally rotate about a hinge 110 near the heel 114 side of the golf club head 102 to compress the hosel 106 and contract the internal circumference of the hosel 106. The contraction of the internal circumference of the hosel 106 may generally cause the internal surface of the hosel 106 to compress around the external surface of the shaft 104, securing the shaft 104 within the hosel 106.

Figure 2:
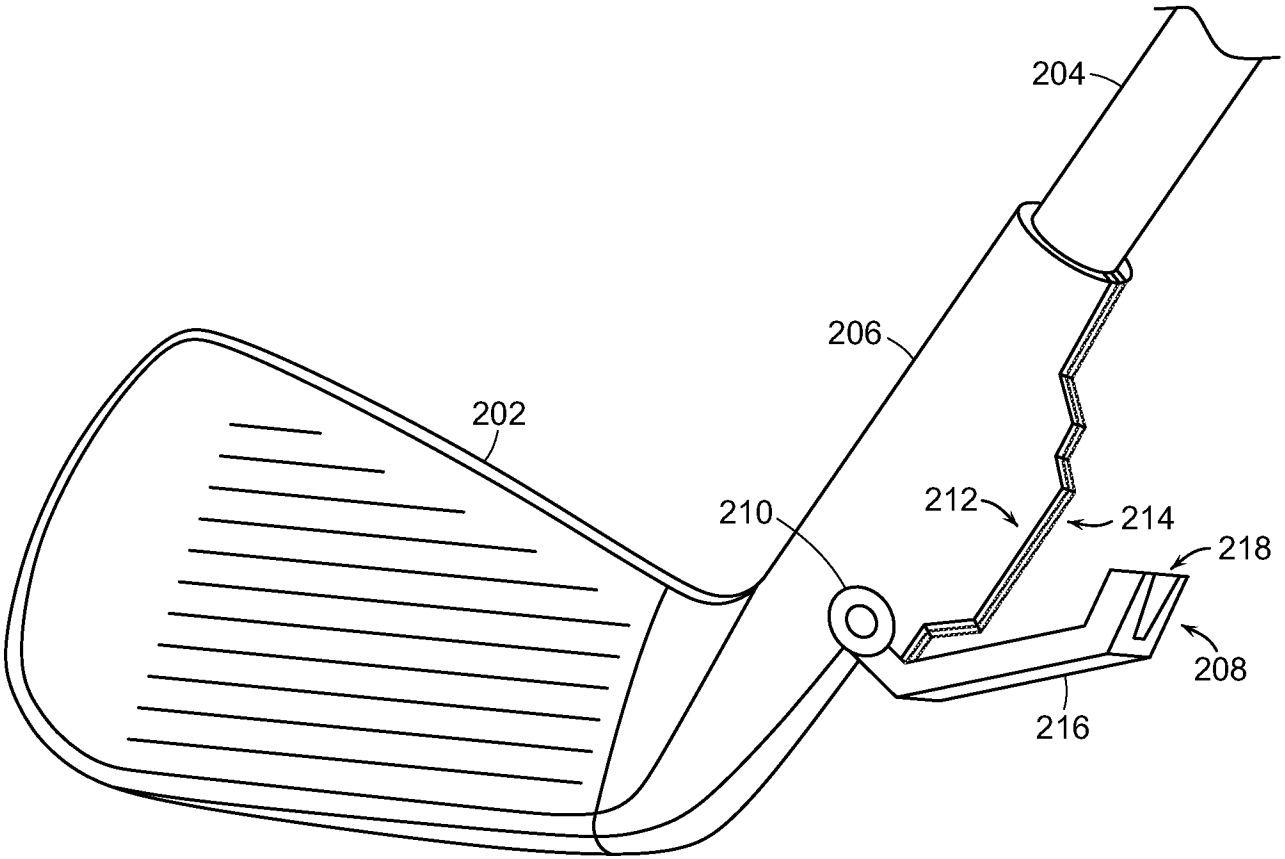
FIG. 2 shows a perspective view of a golf club in accordance with an exemplary embodiment of the present invention.

In order to better understand the functionality of the non-threaded connection mechanism 108, FIG. 2 has been provided to show the non-threaded connection mechanism 208 in an open and non-compressing position. FIG. 2 of the accompanying drawings, with the non-threaded connection mechanism 208 in an open position, shows the internal components of the non-threaded connection mechanism 208 that includes the first flap 212, the second flap 214, the hinge 210, as well as the rotating clamp 216. The first flap 212 may generally run lengthwise along the heelward portion of the hosel 206 extending outwardly from the hosel 206. The second flap 214 may generally be substantially parallel to the first flap 212, and generally runs lengthwise along the heelward portion of the hosel 206 extending outwardly from the hosel 206 as well. It should be noted here FIG. 2 clearly shows the first flap 212 and second flap 214 being part of the hosel 206 itself, hence any movement of the first and second flap, 212 and 214 respectively, will directly affect the geometry, size, and dimension of the hosel 206. Because the first flap 212 and the second flap 214 are substantially parallel to one another and both extend outwardly from the heel portion of the hosel 206, they create a gap within the hosel 206 itself. This gap between the first flap 212 and the second flap 214 allows the internal circumference of the hosel 206 to expand and contract, depending on the distance of the gap between the first flap 212 and the second flap 214.

FIG. 2 of the accompanying drawings also shows a rotating clamp 216 in accordance with an exemplary embodiment of the present invention, wherein the rotating clamp 216 directly engage the first flap 212 as well as the second flap 214 to compress the first flap 212 together with the second flap 214. In order to compress the first flap 212 with the second flap 214, the rotating clamp 216 utilizes a tapered engagement portion 218 that forces the first flap 212 closer and closer to the second flap 214 as the rotating clamp 216 closes in on the hosel 206 itself. The rotating clamp 216, as shown in this current exemplary embodiment, rotates about the hinge 210 in a way that allows the rotating clamp 216 to completely encompass the first flap 212 as well as the second flap 214 in a completely closed position as shown in FIG. 1.

Figure 3:
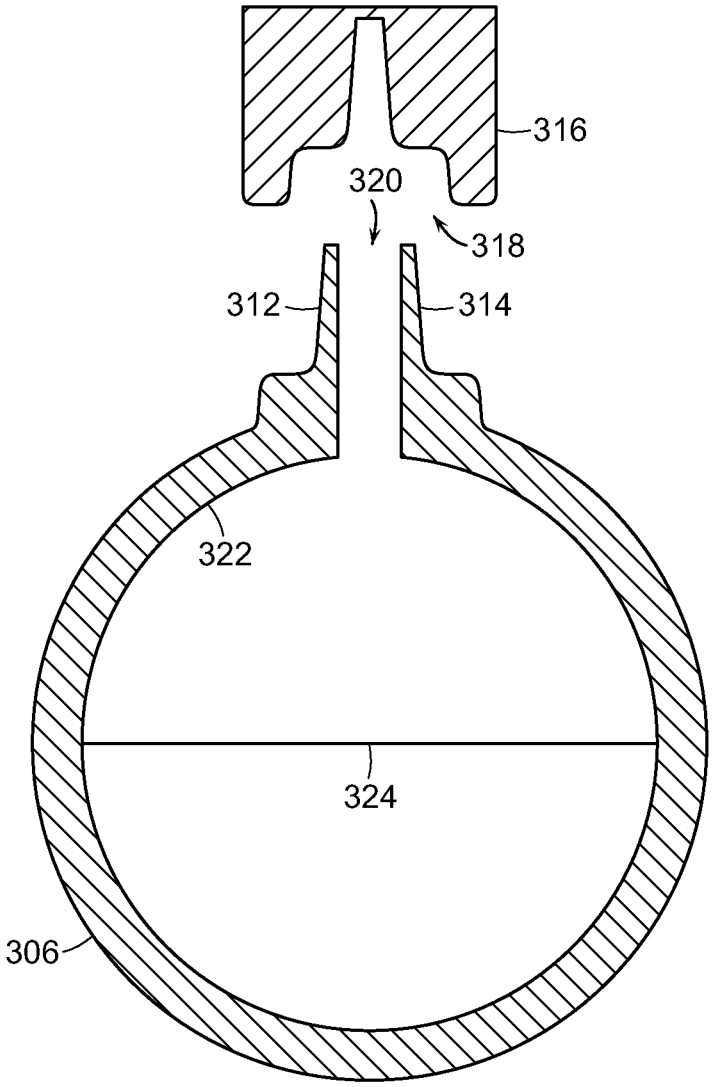
FIG. 3 shows an exploded cross-sectional view of a hosel containing a non-threaded engagement mechanism in accordance with an exemplary embodiment of the present invention.

FIG. 3 of the accompanying drawing shows an exploded cross sectional view of the hosel 306 with the rotating clamp 316 in an open position to further illustrate how the tapered engagement portion 318 engages the first flap 312 as well as the second flap 314 to reduce the distance of the gap 320 in the hosel 306. Because the first flap 312 and the second flap 314 are part of the hosel 306 itself, the reduction in the distance of the gap 320 will generally result in a reduction in the internal circumference 322 of the hosel, quantifiable by a reduction in the internal diameter 324 of the hosel 306. The tapered engagement portion 318, as shown in this exemplary embodiment, may generally conform substantially in shape with the tapering of the first and second flaps 312 and 314 respectively. Thus when the tapered engagement portion 318 of the rotating clamp 316 engages flaps 312 and 314, the angles of tapered engagement portion 318 squeezes the flaps 312 and 314 together, contracting the internal circumference 322 of the hosel 306. Although the relationship between the rotating clamp 316 and the first and second flaps 312 and 314 respectively are fairly easy to see in this exploded view shown in FIG. 3, FIG. 4 of the accompanying drawing is provided below to illustrate more clearly how the rotating clamp 316 engages the first and second flaps 312 and 314 to squeeze and contract the hosel 306.

Figure 4:
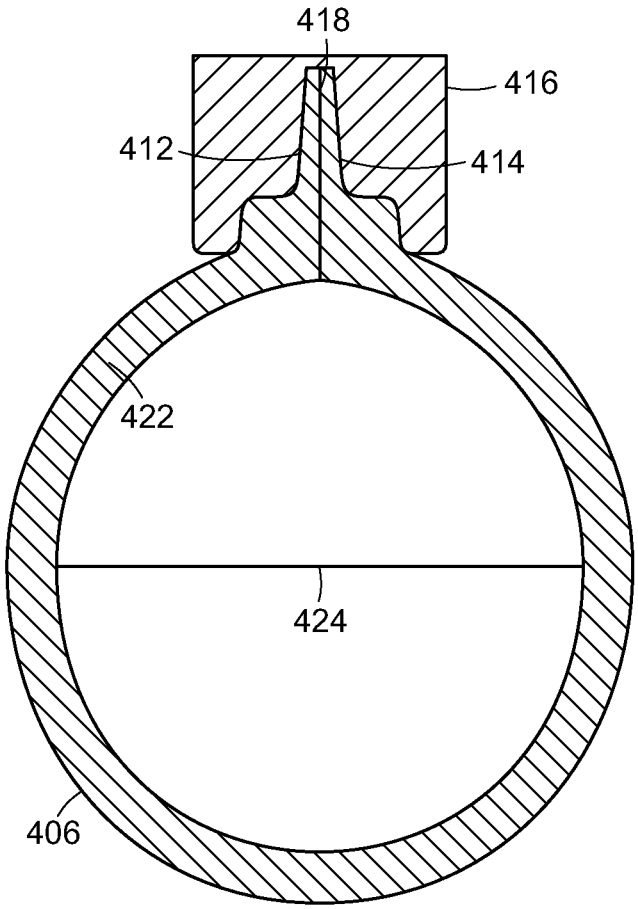
FIG. 4 shows an assembled cross-sectional view of a hosel containing a non-threaded engagement mechanism in accordance with an exemplary embodiment of the present invention.

FIG. 4 of the accompanying drawing shows a cross sectional view of the hosel 406 with the rotating clamp 416 in a closed position; creating a hosel 406 with a smaller internal circumference 422, which in turn, yields a smaller internal diameter 424. Similar to what has already been described above, when the tapered engagement portion 418 engages the first and second flaps 412 and 414, it clamps down on the gap (not shown) that naturally occurs between the first and second flaps 412 and 414 to reduce the internal circumference 422 of the hosel 406.

Figure 5:
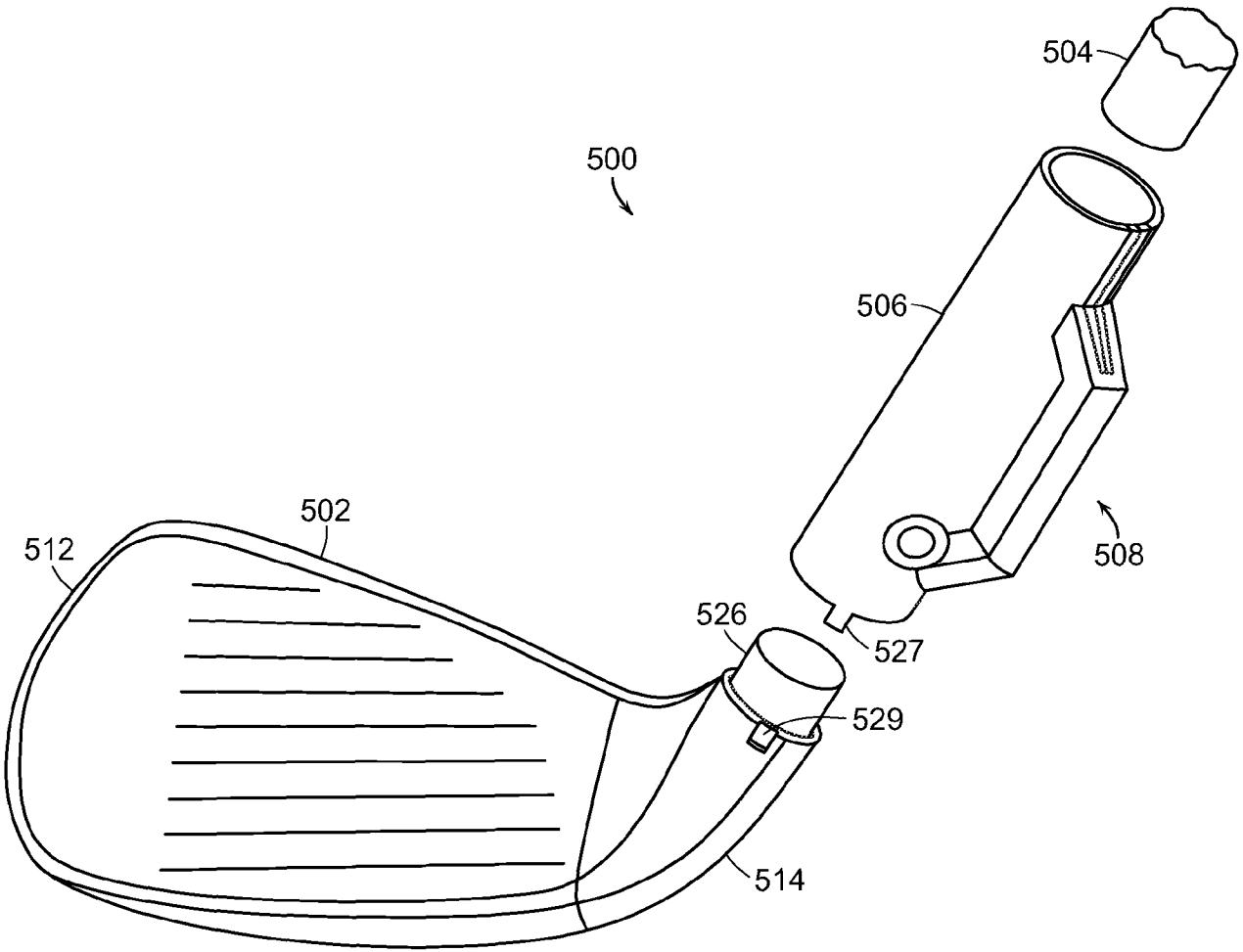
FIG. 5 shows an exploded perspective view of a golf club in accordance with an exemplary embodiment of the present invention.

FIG. 5 of the accompanying drawings shows an exploded perspective view of a golf club 500 in accordance with an exemplary embodiment of the present invention showing the independent nature of the various components. More specifically, FIG. 5 shows a golf club head 502 at a terminal end of the golf club 100 being independent of the hosel 506, which is also independent of the shaft 504. In order to connect the three elements mentioned above, the club head 502, as shown in this current exemplary embodiment, may have a solid protrusion 526 extending outward from the heel portion to engage a receptacle well at the bottom of the hosel 506. The shaft 504, as already indicated above in prior figures, may be inserted into the opposite end of the hosel 506 to complete the connection mechanism. Here, in this current exemplary embodiment, the non-threaded connection mechanism 508 can contract circumferentially to secure both the protrusion 526 as well as the shaft 504 within the internal walls of the hosel 506. It is worth nothing that because the non-threaded connection mechanism 508 contracts internal diameter of the hosel 506 to secure the shaft 504, hosel 506 may accommodate various different shafts 504 with various outer diameters all without departing from the scope and content of the present invention.

It is worth noting that FIG. 5 also shows an additional feature that further helps to prevent the axial rotation between the hosel 506 and the club head 502 in the form of an anti-rotation tab 527 and an anti-rotation notch 529. The anti-rotation tab 527, as shown in this current exemplary embodiment, may generally extend out from the bottom of the hosel 506 to engage the ant-rotation notch 529 on the club head 502. As it can be seen from FIG. 5, the engagement of the anti-rotation tab 529 with the anti-rotation notch 529 prevents the hosel 506 from rotating axially when it is attached to the club head 502. Although FIG. 5 only shows only one anti-rotation tab 527 matched with one anti-rotation notch 529, the current invention may utilizes two sets of anti-rotation tabs and notches, three sets of anti-rotation tabs and notches, or any number of anti-rotation tabs and notches all without departing from the scope and content of the present invention.

Figure 6:
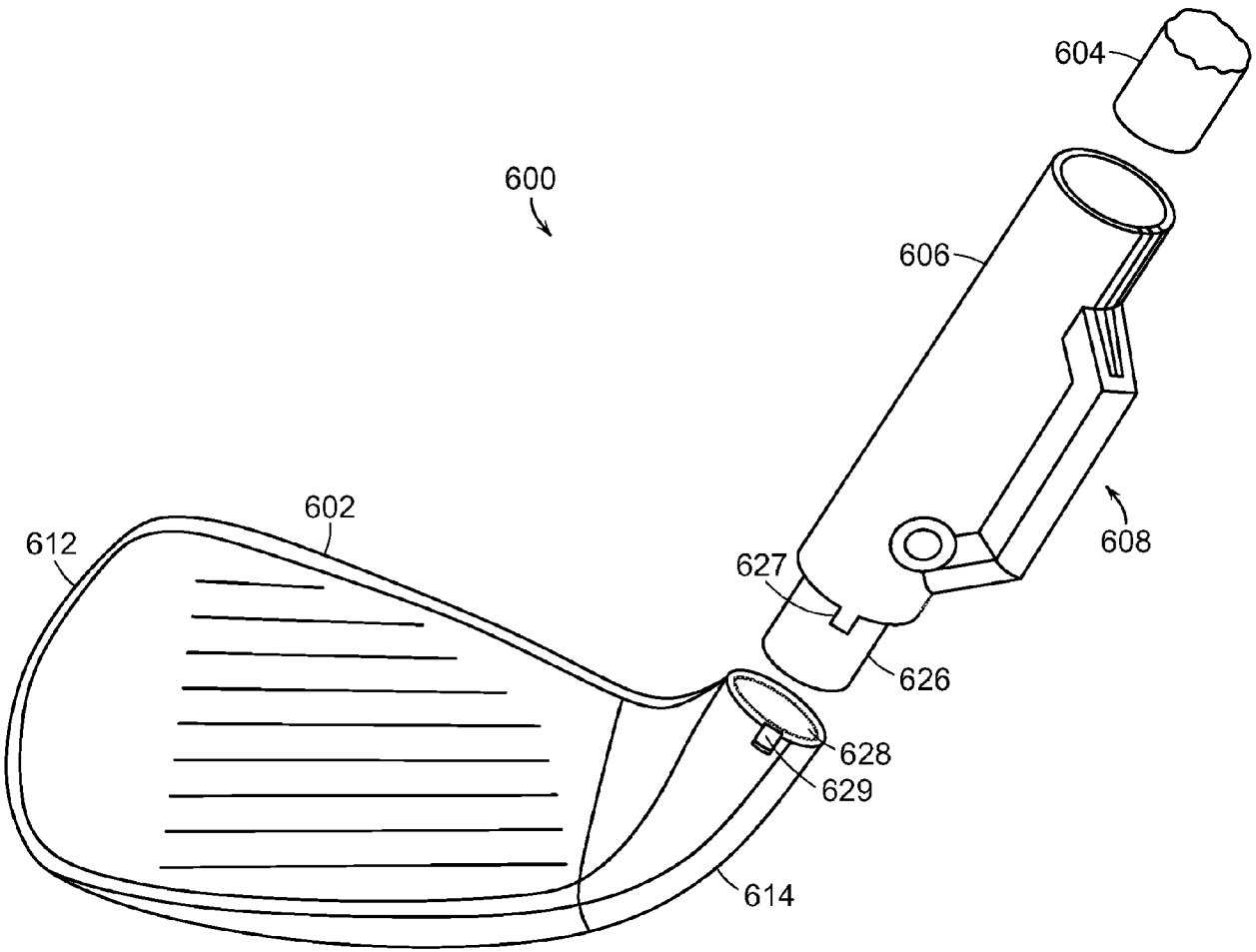
FIG. 6 shows an exploded perspective view of a golf club in accordance with an exemplary embodiment of the present invention.

FIG. 6 of the accompanying drawings shows an exploded view of a golf club 600 in accordance with a further alternative embodiment of the present invention wherein a solid protrusion 626 extends outward from the bottom portion of the hosel 606 and is adapted to engage a receptacle well 628 the club head 602. This alternative embodiment of the present invention may be preferred in certain situations where the outer diameter of the shaft 604 may be different from the outer diameter of the protrusion 526 (shown in FIG. 5), preventing the hosel 506 (shown in FIG. 5) to accommodate both the protrusion 526 (shown in FIG. 5) as well as the shaft 504 (shown in FIG. 5). Hosel 606 and club head 602 may also contain an anti-rotation tab 627 and an anti-rotation notch 629 that functions similar to the previous discussion without departing from the scope and content of the present invention.

Figure 7:
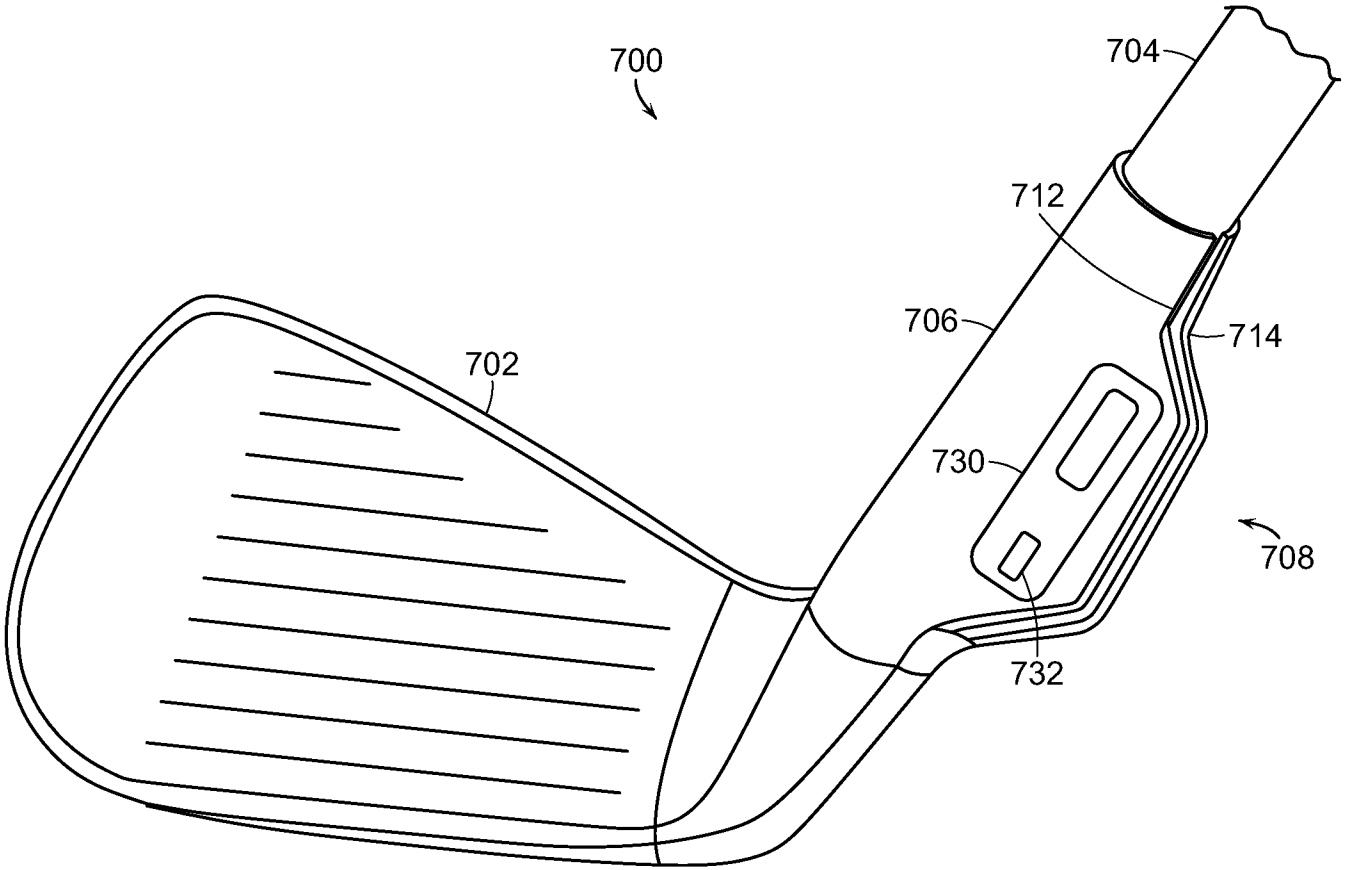
FIG. 7 shows a perspective view of a golf club in accordance with an alternative embodiment of the present invention.

FIG. 7 of the accompanying drawings shows a perspective view of a golf club 700 in accordance with an even further alternative embodiment of the present invention wherein the hosel 706 utilizes a cam type non-threaded connection mechanism 708 to squeezes the first flap 712 together with the second flap 714 to decrease the internal circumference of the hosel 706. Here, in this current exemplary embodiment of the present invention, the cam type non-threaded connection mechanism has a rotating clamp 730, connected to a tightening pin 732, located on the front side of the hosel 706 to clamp together the first flap 712 with the second flap 714. Although the exact functionality of the cam type non-threaded connection mechanism 708 will be explained in more detail in FIG. 8, the cam type non-threaded connection mechanism functions by rotating the rotating clamp 730 about an offset hinge hole to provide the compression force between the two flaps 712 and 714.

Figure 8:
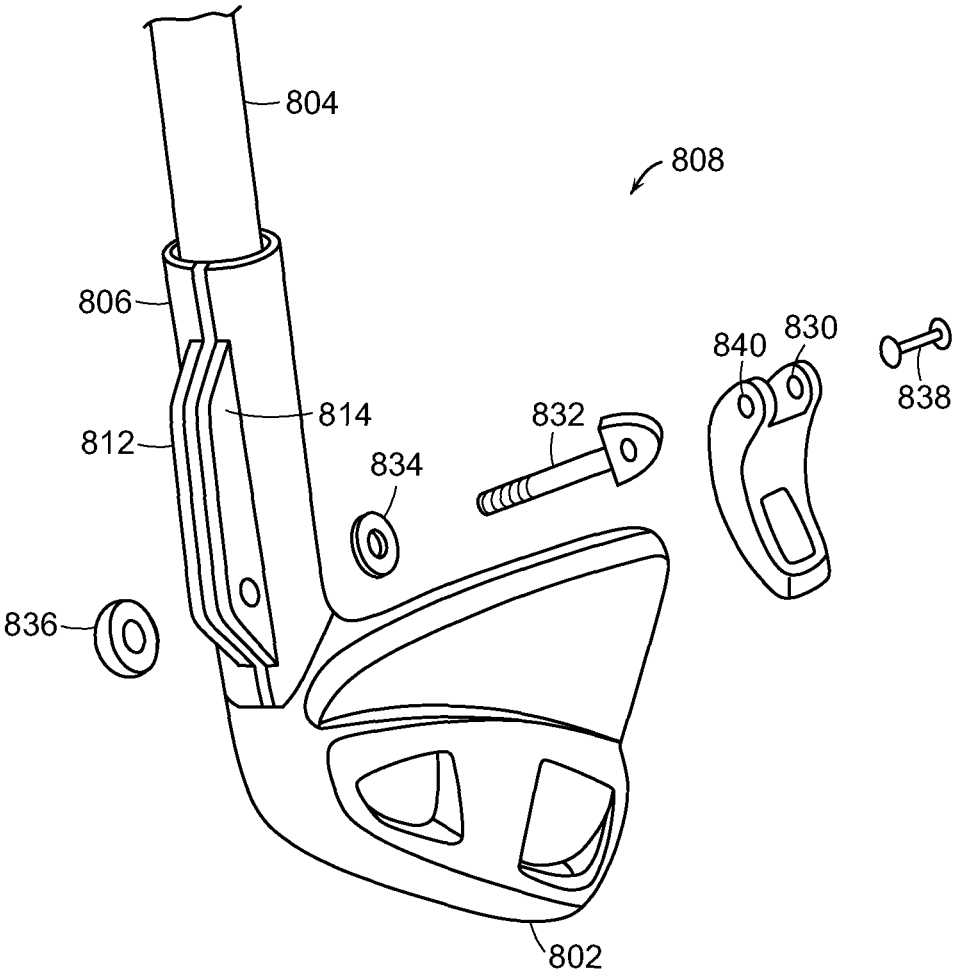
FIG. 8 shows an exploded perspective view of a golf club in accordance with an alternative embodiment of the present invention.
Figure 9A:
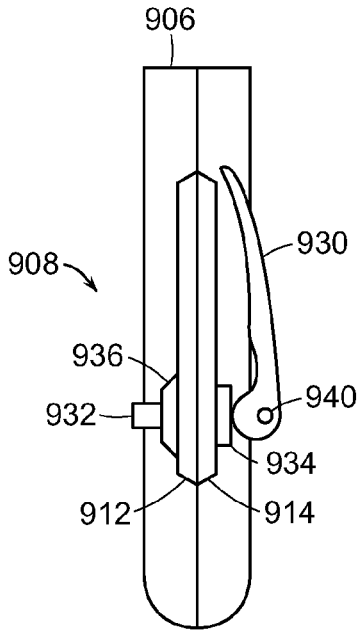
FIG. 9A shows a frontal view of a hosel containing a non-threaded engagement mechanism in accordance with an alternative embodiment of the present invention.
Figure 9B:
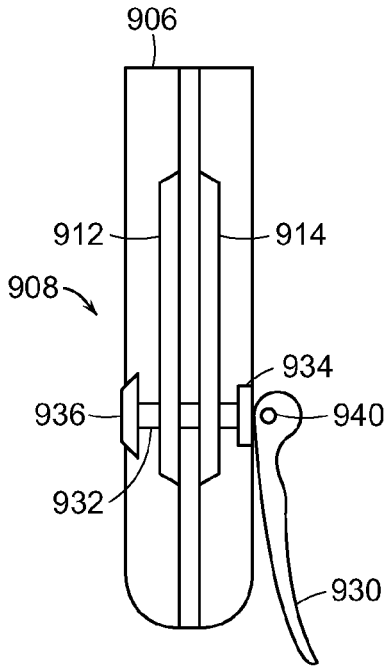
FIG. 9B shows a frontal view of a hosel containing a non-threaded engagement mechanism in accordance with an alternative embodiment of the present invention.

FIG. 8 of the accompanying drawing, showing an exploded perspective view of a golf club 800 in accordance with an even further alternative embodiment of the present invention, provides a clearer visual of the various components of this cam type connection mechanism 808. This cam type connection mechanism 808 could be considered a different type of non-threaded mechanism because the tightening and loosening of the cam type connection mechanism 808 does not involve the usage of threads. First and foremost, it can be seen from FIG. 8 that in this alternative embodiment, the rotating clamp 830 may be placed at the back side of the hosel 806 to achieve the same objective as if it was placed at the front side of the hosel 806 without departing from the scope and content of the present invention. FIG. 8 shows the cam type connection mechanism 808 comprising of a rotating clamp 830, a tightening pin 832, a washer 834, a stopper 836, and a hinge pin 838. This alternative embodiment of the connection mechanism 808 utilizes an offset hinge hole 840 within the rotating clamp 830 that rotates about the hinge pin 838 to push the washer 834 into the second flap 814 of the hosel 806. Because the hinge hole 840 is offset from the center of the rotating clamp 830, the distance between the hinge hole 840 and the washer 834 changes depending on the orientation of the rotating clamp 830, creating the compression force when the hinge hole 840 is rotated further away from the washer 834. FIGS. 9A and 9B showing enlarged frontal views of the non-threaded connection mechanism 808 being in both the open and the closed position will further help illustrate operation of this connection mechanism 808.

FIG. 9A of the accompanying drawings shows an enlarged frontal view of the connection mechanism 908 in a closed position, utilizing the offset hinge hole 940 to adjust the amount of pressure exerted onto the washer 934, which works in conjunction with the stopper 936 to clamp the first flap 912 with the second flap 914. This enlarged frontal view of the connection mechanism 908 in accordance with this alternative embodiment of the present invention shows how the offset location of the hinge hole 940, combined with geometry of the rotating clamp 940, creates a cam that changes the tension between the first flap 912 and the second flap 914 with a simple turn of the rotating clamp.

Figure 10:
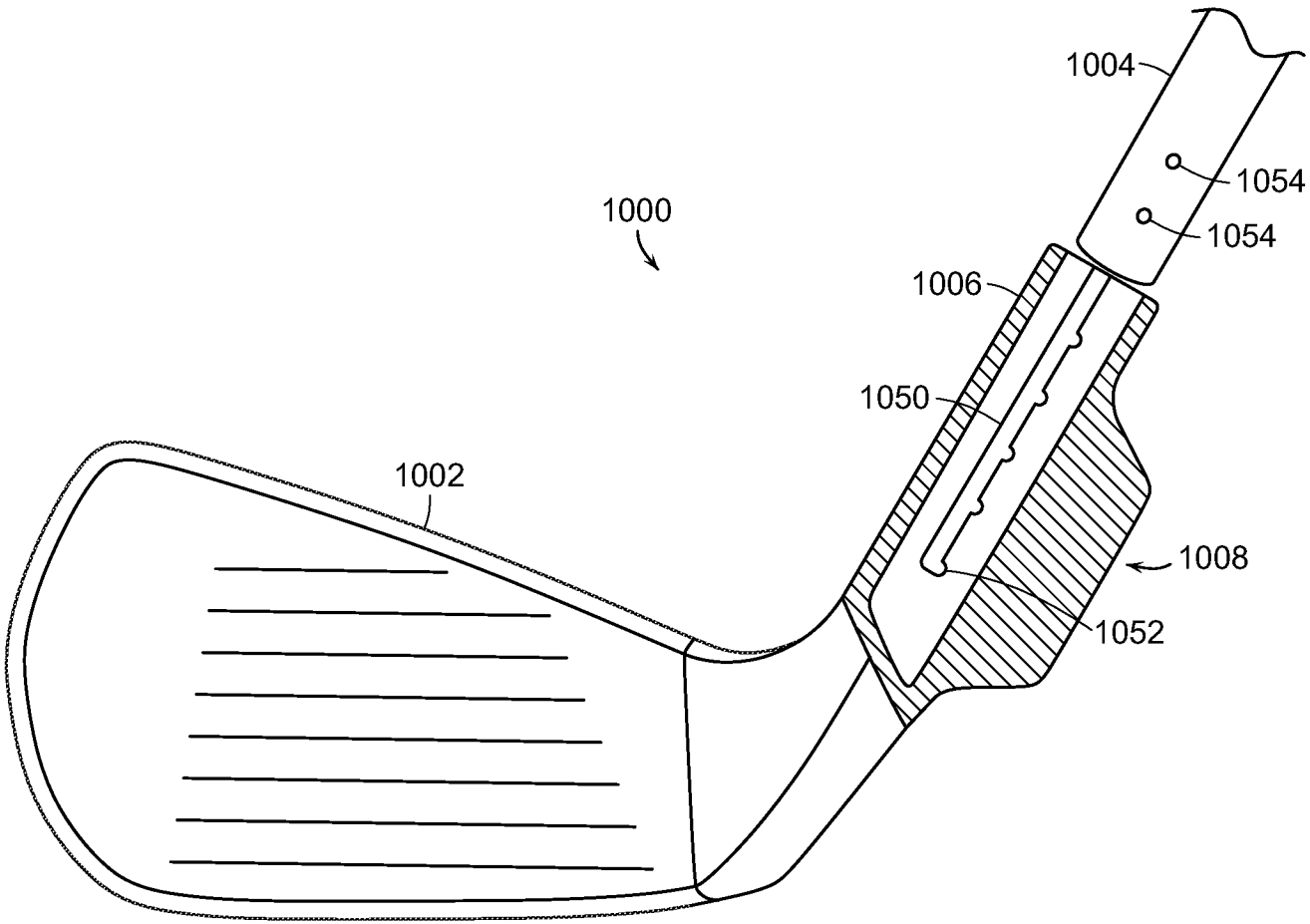
FIG. 10 shows a partial cross-sectional view of a golf club in accordance with a further alternative embodiment of the present invention.

FIG. 9B of the accompanying drawings, on the other hand, shows an enlarged frontal view of the connection mechanism 908 in an open position, relieving the tension between the first flap 912 and the second flap 914 shown in FIG. 9A. Once again, we can see from FIG. 9B, the offset location of the hinge hole 940, combined with the geometry of the rotating clamp 930 creates a cam, allowing a simple turn of the rotating clamp 930 to relieve the tension generated between the first flap 912 and the second flap 914. More information on this concept of an offset hinge hole 940 working in conjunction with a rotating clamp can be found in U.S. Pat. No. 5,597,362 to Lee et al, U.S. Pat. No. 5,165,762 to Phillips, and U.S. Pat. No. 5,238,259 to Wilson et al, the disclosure of which are all incorporated by reference in its entirety FIG. 10 of the accompanying drawings shows a partial cross-sectional view of a golf club 1000 in accordance with a further alternative embodiment of the present invention offering an ability to adjust the length of a golf club 1000 using the already existing hosel 1006 and the non-threaded connection mechanism 1008. More specifically, the hosel 1006 may have one or more channels 1050 along the internal walls of the hosel 1006 itself; wherein each of the channels 1050 may have one or more twisting stoppers 1052 allowing the shaft 1004 to penetrate the hosel 1006 at specific predetermined depths. The one or more channels 1050 containing one or more twisting stoppers 1052 work in conjunction with one or more bumps 1054 to help guide the shaft 1004 into the hosel 1006 at specific predetermined depth, allowing for an adjustment in the overall length of the golf club 1000 without departing from the scope and content of the present invention.

Figure 11:
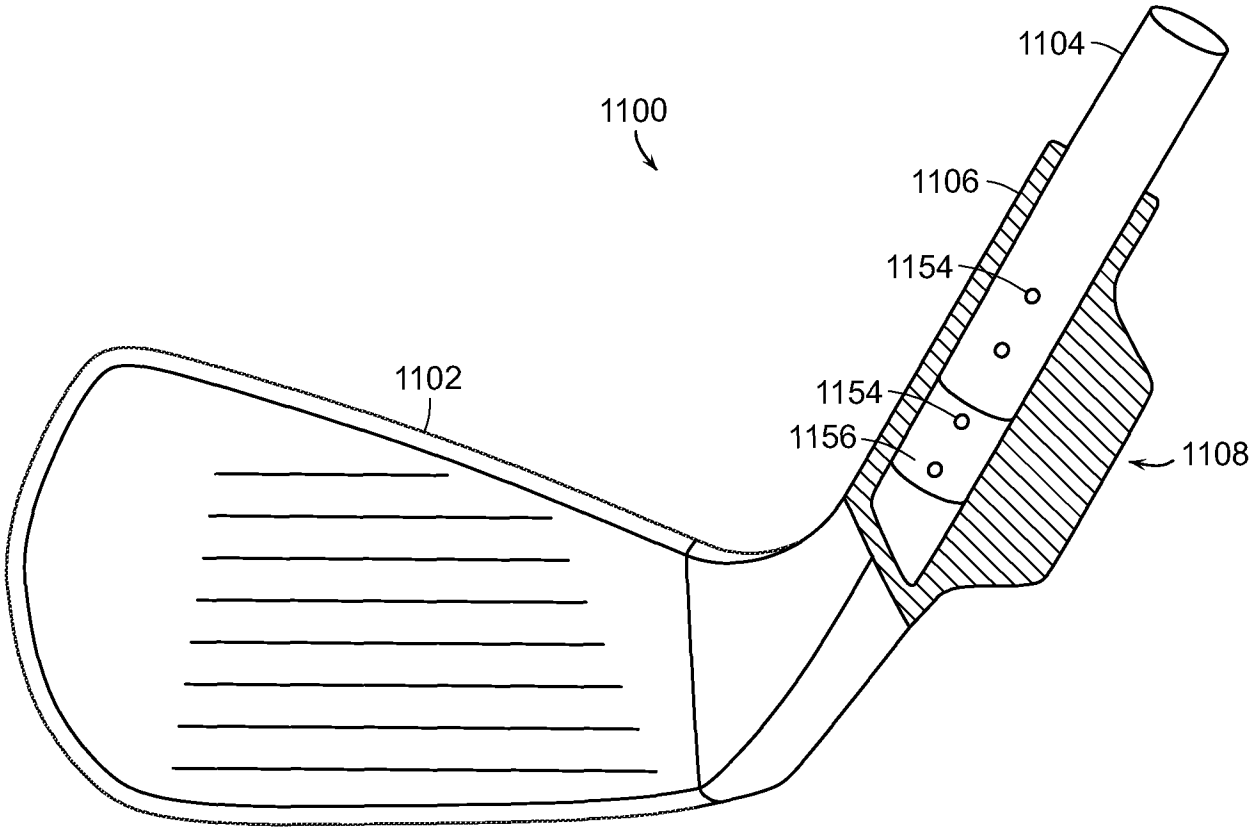
FIG. 11 shows a partial cross-sectional view of a golf club in accordance with a further alternative embodiment of the present invention.

In accordance with a further alternative embodiment of the present invention, FIG. 11 of the accompanying drawing shows a partial cross-sectional view of the golf club head 1100 illustrates a shaft 1104 with a tip 1156 that is made out of a different material that can be secured into the bottom of the hosel 1106 before the shaft 1104 is inserted into the hosel 1106. Having a tip 1156 that is made out of different material than the remainder of the shaft 1104 may be desirable in changing the weighting characteristics of the golf club 1100. In one example, the tip 1156 could be made out of a material having a high density such as tungsten, lead, or any other material that has a relatively high density compared to the density of the shaft to alter the performance characteristics of the golf club 1100. In another example, the tip 1156 could be made out of a material having a lower density such as plastic, rubber, or any other material that has a relatively low density compared to the density of the shaft to alter the performance characteristics of the golf club 1100. In addition to the density and weight changes, tip 1156 could also be made out of a vibration dampening material that can absorb the undesirable harsh vibrations of the golf club head 1102.

Figure 12:
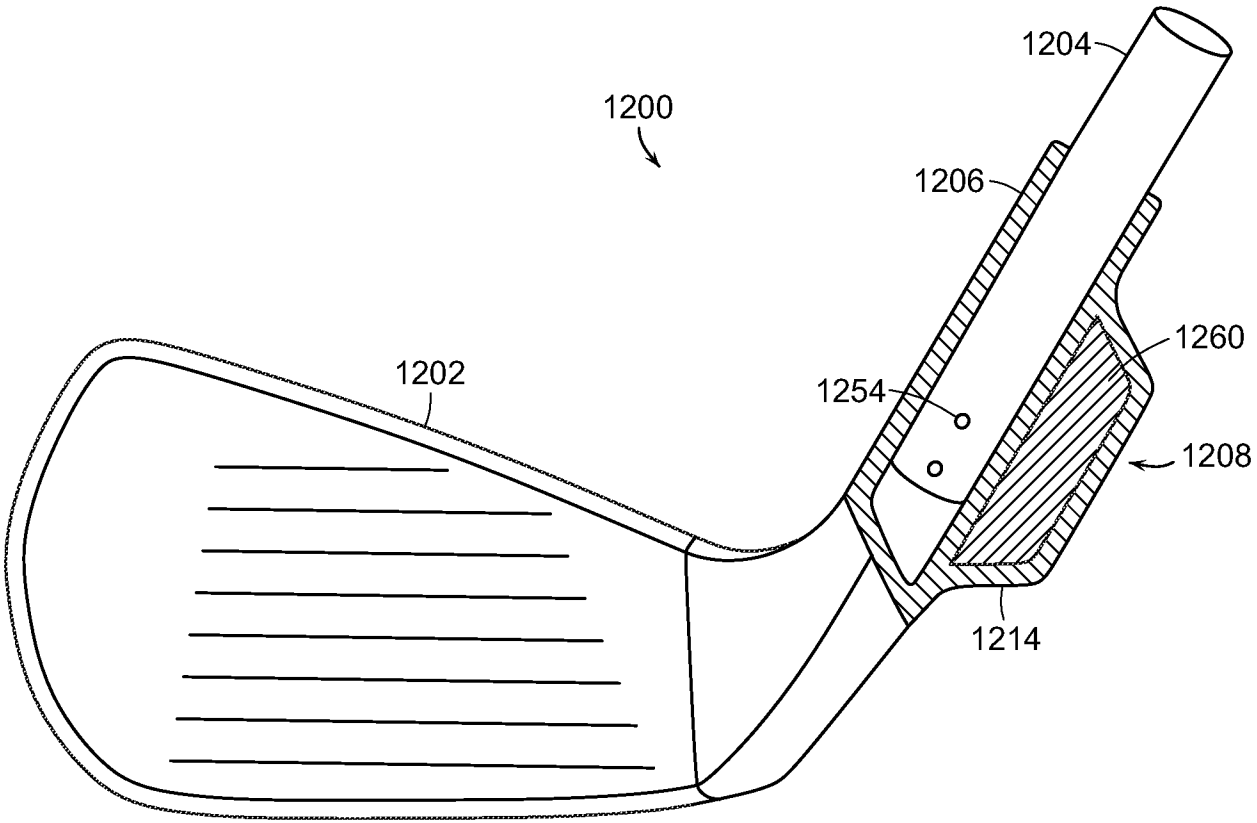
FIG. 12 shows a partial cross-sectional view of a golf club in accordance with a further alternative embodiment of the present invention.

FIG. 12 of the accompanying drawings shows another partial cross-sectional view of a golf club head 1200 in accordance with a further alternative embodiment of the present invention. Golf club head 1200 shown in FIG. 12, instead of having a tip made out of different material, may place add an weight adjustment member 1260 within the flap 1214 of the non-threaded connection mechanism 1208 of the hosel 1206. Having additional weight near the flap 1214 portion of the hosel 1206 that extends out from the heel portion of the golf club head 1202 may generally be desirable, as such a weight placement increases the moment of inertia about the shaft axis; providing the golf club head 1202 with more forgiveness.

Figure 13:
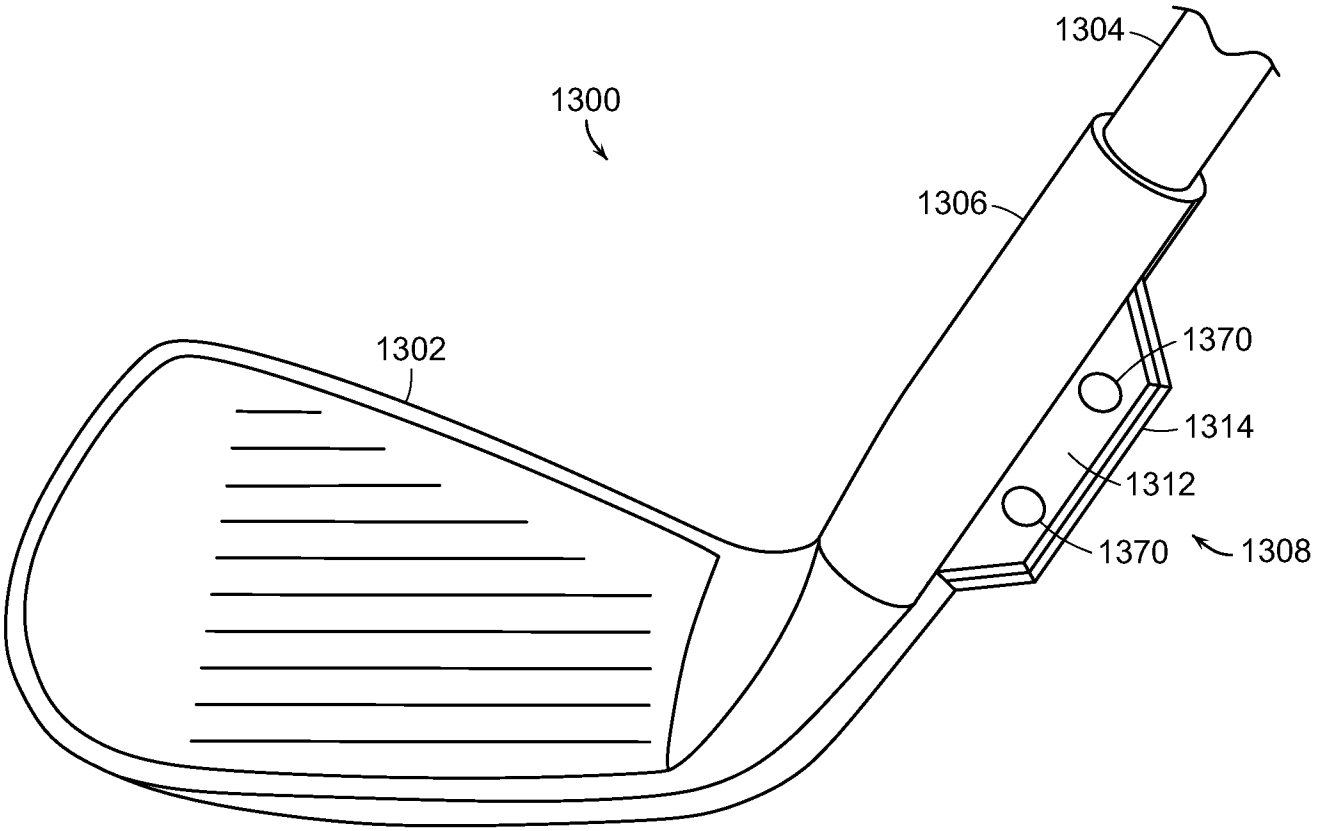
FIG. 13 shows a perspective view of a golf club in accordance with an even further alternative embodiment of the present invention.

FIG. 13 of the accompanying drawings shows a perspective view of a golf club 1300 in accordance with a further alternative embodiment of the present invention. In this alternative embodiment of the present invention the non-threaded connection mechanism 1308 within the hosel 1306 of the golf club head 1302 may utilize a one or more screws 1370 to provide the force necessary to engage the first flap 1312 with the second flap 1314 to contract the internal circumference of the hosel 1306. Similar to the discussion above, this contraction of the internal circumference of the hosel 1306 provides sufficient clamping force on the shaft 1304 to retain the shaft 1304 within the hosel 1306.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club comprising:

a shaft;

a club head; and a hosel, wherein an end of said hosel attaches to said golf club head, said hosel further comprising a connection mechanism applies a tangential force to secure said shaft to said hosel, wherein said connection mechanism contracts an internal circumference of said hosel to directly contact said shaft within said hosel, said connection mechanism is further comprising:

a first flap running lengthwise along said hosel extending outward from said hosel;

a second flap substantially parallel to said first flap running lengthwise along said hosel extending outward from said hosel such that said first flap and said second flap creates a gap in said internal circumference of said hosel; and a rotating clamp adapted to rotationally compress said first flap with said second flap, wherein said rotating clamp decreases said internal circumference of said hosel when it compresses said first flap with said second flap, wherein said hosel comprises a solid protrusion at a bottom portion of said hosel adapted to engage a receptacle well located near a heel portion of said club head.

2. The golf club of claim 1, wherein said solid protrusion located at said bottom portion of said hosel has an outer diameter that is substantially different from an outer diameter of said shaft.

3. The golf club of claim 1, wherein said hosel further comprises an anti-rotation tab to engage an anti-rotation notch on said club head to prevent axial rotation between said hosel and said club head.

4. The golf club of claim 1, wherein said rotating clamp comprises a tapered engagement portion adapted to engage said first flap and said second flap simultaneously to decreases said internal circumference of said hosel.

5. A golf club head comprising:

a striking face at a forward portion of said golf club head for striking a golf ball;

a body portion connected to an aft portion of said striking face providing structural support; and a hosel wherein an end of said hosel attaches to said golf club head, said hosel further comprising, a first connection end adapted to connect to said heel portion of said body portion;

a second connection end adapted to connect to a shaft; and a connection mechanism protruding externally from said hosel, wherein said connection mechanism applies a tangential force to reduce an internal circumference of said hosel to directly contact said shaft to said hosel.

6. The golf club head of claim 5, wherein said hosel comprises a solid protrusion at one end of said hosel adapted to engage a receptacle well located near said heel portion of said club head.

7. The golf club head of claim 6, wherein said solid protrusion located at said one end of said hosel has an outer diameter that is substantially different form an outer diameter of said shaft.

8. The golf club of claim 6, said connection mechanism is further comprising:

a first flap running lengthwise along said hosel extending outward from said hosel;

a second flap substantially parallel to said first flap running lengthwise along said hosel extending outward from said hosel such that said first flap and said second flap creates a gap in said internal circumference of said hosel; and a rotating clamp adapted to rotationally compress said first flap with said second flap, wherein said rotating clamp decreases said internal circumference of said hosel when it compresses said first flap with said second flap.

9. The golf club of claim 8, wherein said rotating clamp comprises an offset hinge hole adapted to engage a tightening pin to decease said internal circumference of said hosel.

10. The golf club of claim 6, wherein said rotating clamp comprises a tapered engagement portion adapted to engage said first flap and said second flap simultaneously to decrease said internal circumference of said hosel.

11. The golf club of claim 6, wherein said hosel further comprises an anti-rotation tab to engage with an anti-rotation notch on said club head to prevent axial rotation between said hosel and said club head.

12. A golf club head comprising:

a body; and a hosel, wherein an end of said hosel attaches to said golf club head;

said hosel further comprising a connection mechanism to secure a shaft to said hosel, and said connection mechanism further comprising, a first flap running lengthwise along said hosel extending outward from said hosel;

a second flap substantially parallel to said first flap running lengthwise along said hosel extending outward from said hosel such that said first flap and said second flap creates a gap in said internal circumference of said hosel; and a rotating clamp adapted to rotationally compress said first flap with said second flap;

wherein said rotating clamp decrease said internal circumference of said hosel when it compresses said first flap with said second flap, wherein said hosel comprises a solid protrusion at one end of said hosel adapted to engage a receptacle well located near a heel portion of said club head.

13. The golf club head of claim 12, wherein said rotating clamp comprises an offset hinge hole adapted to engage a tightening pin to decease said internal circumference of said hosel.

14. The golf club head of claim 13, wherein said hosel further comprises an anti-rotation tab to engage with an anti-rotation notch on said club head to prevent axial rotation between said hosel and said club head.

* * * * *